United States Patent [19]

Kleis

[11] 4,233,472

[45] Nov. 11, 1980

[54] LOUDSPEAKER COMBINATION, COMPRISING A PLURALITY OF DYNAMIC LOUDSPEAKERS, WHICH ARE ARRANGED ADJACENT EACH OTHER IN SUBSTANTIALLY ONE CONTINUOUS PLANE

[75] Inventor: Derk Kleis, Breda, Netherlands

[73] Assignee: U.S. Philips Corporation, New York, N.Y.

[21] Appl. No.: 924,361

[22] Filed: Jul. 13, 1978

[30] Foreign Application Priority Data

Jul. 26, 1977 [NL] Netherlands ..... 7708256

[51] Int. Cl.[3] ..... H04R 5/02

[52] U.S. Cl. ..... 179/1 GA; 179/1 D

[58] Field of Search ..... 179/1 AT, 1 D, 1 E, 179/1 GA

[56] References Cited

FOREIGN PATENT DOCUMENTS 1122851 8/1968 United Kingdom .

OTHER PUBLICATIONS

*Radio Engineers Handbook*, 1943, F. E. Terman, pp. 249–251.

*Primary Examiner*—James W. Moffitt

*Attorney, Agent, or Firm*—T. A. Briody; Bernard Franzblau

[57] ABSTRACT

A loudspeaker combination comprising a plurality of sections of dynamic loudspeakers which are arranged adjacent each other in substantially one continuous plane. A number of these sections can be muted at increasing frequency under the influence of a low-pass filter. All loudspeaker sections are connected in series with each other and each mutable loudspeaker section is shunted by a capacitor. Each low-pass filter is constituted by the impedance of a mutable loudspeaker section with the associated capacitor. One loudspeaker section is not shunted by a capacitor and comprises at least two loudspeakers with the axes of the loudspeakers diverging relative to each other. This has the advantage that the loudspeaker combination has a virtually constant angle of aperture over a wide frequency range.

6 Claims, 3 Drawing Figures

LOUDSPEAKER COMBINATION, COMPRISING A PLURALITY OF DYNAMIC LOUDSPEAKERS, WHICH ARE ARRANGED ADJACENT EACH OTHER IN SUBSTANTIALLY ONE CONTINUOUS PLANE

The invention relates to a loudspeaker combination comprising a plurality of sections of dynamic loudspeakers which are arranged adjacent each other in substantially one continuous plane, while a number of these sections being mutable at increasing frequency as a result of the influence of low-pass filters. The invention further relates to a loudspeaker combination comprising a plurality of serially connected dynamic loudspeakers arranged adjacent each other in substantially one continuous plane with all, except one, shunted by a capacitor, which also causes muting of the loudspeakers at increasing frequency. Each loudspeaker section comprises at least one loudspeaker.

The first loudspeaker combination is known from U.S. Pat. No. 3,138,667. This patent describes a loudspeaker column which column comprises 4 sections of three loudspeakers, of which 2 sections are connected in parallel with each other to a first low-pass filter and 1 section to a second low-pass filter with a higher cut-off frequency. The second loudspeaker combination is known from U.K. Pat. No. 1,122,851. This patent describes a loudspeaker column having 9 loudspeaker sections one of which (the middle one) is non-mutable. The other eight are muted sequentially at increasing frequency by shunting every loudspeaker section by a capacitor.

Each of these loudspeaker columns exhibits a directivity pattern whose major lobe in the 0° direction is not very distinct and is situated between two directions which are defined by the effective length of the column. This length is reduced as the frequency to be reproduced increases. This reduction takes place in steps, namely by the muting of the loudspeaker sections which are connected to a low-pass filter.

If the frequency is higher than the cut-off frequency of the first filter, the corresponding loudspeaker section is muted and the effective length of the column thus decreases, which results in a wider directivity pattern.

As the frequency increases this directivity pattern is narrowed until a specified limit value is reached, after which the second loudspeaker section is muted and the effective length of the column is further reduced. As a result of this, the directivity pattern is widened again, and is now determined by the length of the remaining loudspeaker sections and so on until the last, i.e. the non-mutable section, remains.

As the loudspeaker sections are connected in parallel to the line voltage, this successive muting of the loudspeaker sections will cause the sound pressure in the 0°-direction to decrease for an increasing frequency because the number of active loudspeakers is reduced.

This decrease can be compensated for by providing the associated audio amplifier, to which the loudspeaker combination is connected, with a correction network with suitable pre-emphasis.

It is an object of the invention to provide a far simpler solution, for which the amplifier itself need not be modified, and the invention is characterized in that all loudspeaker sections are connected in series with each other and that each mutable loudspeaker section is shunted by a capacitor, each low-pass filter comprising the impedance of a mutable loudspeaker section with the associated capacitor.

In accordance with the invention the loudspeaker sections may be arranged in line or in a two-dimensional configuration. When the loudspeaker sections are arranged in line and each loudspeaker section comprises a single loudspeaker, a simple loudspeaker column may thus be constructed by connecting a plurality of identical loudspeakers in series and shunting a number of them by capacitors of each time decreasing value.

When the line voltage is U volts and the number of loudspeakers is N, the voltage across each active loudspeaker will be $U/_N$ volts. The sound pressure in the 0° direction, which is proportional to $N.U/_N$, then remains constant.

Thus, this circuit arrangement provides a so-called "built-in" preemphasis. When the loudspeakers or loudspeaker sections are muted, the impedance of the loudspeaker combination continuously decreases. However, this decrease is partly compensated for by the increase of the impedance of each active dynamic loudspeaker at increasing frequency.

After the last loudspeaker section—i.e. the one which is shunted by the smallest capacitor—has been muted, the directivity pattern of the loudspeaker combination is determined by the dimension of the two-dimensional configuration or the length of the line configuration of the remaining loudspeaker sections.

At increasing frequency the beam then still becomes very narrow. For the loudspeaker combination from the British Patent it becomes equal to the beam of the non-mutable loudspeaker. This narrowing is highly undesirable for virtually all loudspeaker-column applications because as a result of this some of the listeners may then be situated outside the space being sonorised.

Since for a satisfactory intelligibility for the whole audience the sound distribution should be uniform with a tolerance of not more than 3 dB up to at least a frequency of 5000 Hz, the angle of aperture of the beam (in the vertical plane) should not fall below a certain limit value. Obviously, this limit value entirely depends on the space to be sonorised.

This may be achieved in accordance with the invention by providing at least two loudspeakers in the loudspeaker section without capacitors and by diverging the axes of these two loudspeakers relative to each other. Use is then made of the directivity patterns of each of these loudspeakers so that no dip is formed in the directivity pattern of the loudspeaker combination (loudspeaker column) in the 0° direction of the column, if the angle enclosed by the axes is smaller than the angle of aperture of the individual loudspeakers.

It should be noted that the aforesaid U.S. Pat. describes a loudspeaker column in which the non-mutable loudspeaker section comprises more than one loudspeaker. The axes of these loudspeakers, however, do not diverge relative to each other. As a consequence the loudspeaker column in the U.S. Patent suffers the same disadvantage as that of the British patent, i.e. at increasing frequency the beam still becomes very narrow.

Furthermore the loudspeaker combination according to the invention has a further advantage over the loudspeaker columns of the U.S. and British patents in that a constant acoustic energy is radiated independently of the frequency.

This can be explained as follows. The loudspeaker combination from the British patent and the combination according to the invention exhibit a frequency-independent sound pressure in the 0°-direction. This sound pressure is proportional to the line voltage across the loudspeaker combination provided by the audio amplifier. As a result of the successive muting of some loudspeaker sections at increasing frequency, the same line voltage is applied to a smaller number of loudspeaker sections resulting in the same sound pressure in the 0°-direction.

Only the loudspeaker combination according to the invention exhibits a constant angle of aperture of the beam, independent of the frequency, owing to the diverging axes of the non-mutable loudspeakers. The constant sound pressure in the 0°-direction and the constant angle of aperture of the beam result in a constant acoustic energy radiation which is independent of the frequency.

If the line voltage is maintained constant, the power in each loudspeaker section will increase as the frequency increases owing to the successive muting of the loudspeaker sections. As a result of this, the load of the remaining loudspeakers increases continually. At the normal nominal load of the loudspeakers these loudspeakers will not be overloaded, because the radiated power decreases by approximately 9 dB/octave from approximately 500 Hz both for speech and music. However, the treble control can be set to a + position and in public address systems howling may be produced as a result of acoustic feedback. In that case it is not unlikely that the remaining loudspeakers will be damaged by overloading.

In order to prevent this, at least one loudspeaker section with a shunt capacitor, in a preferred embodiment of the invention, has the capacitor connected in series with at least one incandescent lamp. This step, which is known per se, protects the loudspeaker against excess currents so that the relevant loudspeaker is not overloaded.

As previously stated, the loudspeaker sections may be arranged in line in a column or in a two-dimensional configuration. When they are arranged on both sides or around a central section, which is not provided with a capacitor, the loudspeakers of the central sections, in accordance with the invention, will be arranged in one plane or with two dimensionally diverging axes respectively. It is alternatively possible to arrange these sections symmetrically around a central section, the axes of the loudspeakers of the central section diverging relative to each other and, furthermore, said loudspeakers not being provided with a capacitor.

The invention will now be described in more detail with reference to the accompanying drawing, in which.

Figure 1:
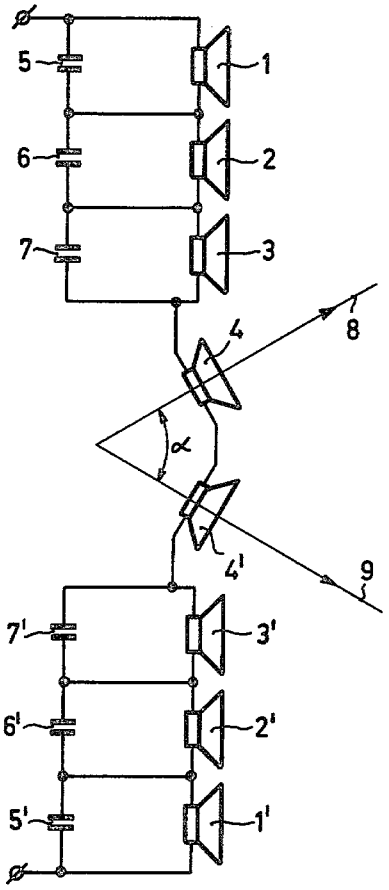
FIG. 1 shows a loudspeaker column in accordance with the invention.

The loudspeaker column of FIG. 1 comprises 8 identical cone loudspeakers of the electro-dynamic type which are arranged in 4 sections. The two loudspeakers of each section are symmetrical relative to the centre. Thus, loudspeakers 1 and 1' constitute one section and the loudspeakers 2 and 2', 3 and 3', and 4 and 4' the next sections. These sections are hereinafter referred to by the reference numerals of the loudspeakers, i.e. by 1 through 4. Except for the loudspeakers of section 4, all loudspeakers are shunted by a capacitor. The loudspeakers 1 and 1' are provided with a capacitor 5 and 5' respectively; loudspeakers 2 and 2' with a capacitor 6 and 6' respectively, loudspeakers 3 and 3' with a capacitor 7 and 7' respectively. Thus capacitors within each section are identical. The capacitors of section 1 have a higher value than those of section 2, which in their turn have a higher value than those of section 3.

The loudspeakers and the capacitors are connected in parallel with each other. In each of the sections 1 through 3 the resistance R of the loudspeaker with the associated capacitor constitute a low-pass filter, which ensures that signals with frequencies above the cut-off frequency—determined by the RC-product—are not applied to the loudspeaker. At the cut-off frequency the applied signal has already been attenuated by approximately 3 dB and at higher frequencies the attenuation increases by approximately 6 dB/octave. If the distance between the loudspeakers is 11 cm, the total length of the loudspeaker column will be approximately 90 cm.

For this loudspeaker column, which for public address use should cover an audience (head level 1.25–1.75 m) the normal height, i.e. underside column above floor level, is 2 to 2.5 m. It is aimed at the back of the audience. For a satisfactory intelligibility the angle of aperture in the vertical plane should be between 15° and 30°. The selected value depends on the space to be sonorised, such as for example the slope of the floor in a backward direction.

Angle of aperture is to be understood to mean the angle in the symmetrical plane through the longitudinal direction of the column for which the bounding lines indicate a sensitivity which is 6 dB lower than in the 0° direction.

As the frequency of the applied signal increases, the directivity pattern—i.e. the major lobe, and thus the angle of aperture narrows increasingly.

For the above-mentioned reasons, this angle of aperture should not be smaller than the selected value of 15 to 30 degrees. For this purpose the sections 1 through 3 are successively muted at increasing frequencies.

The effective length of the column decreases continually and consequently the angle of aperture increases.

The cut-off frequencies for sections 1 through 3 have been selected to equal successively 900, 1200 and 1800 Hz at a minimum angle of aperture of 30 degrees.

The successive loudspeaker sections are muted gradually. When sections 1 through 3 have been muted, which is effected at frequencies which are above 1800 Hz, the angle of aperture will be 30 degrees at approximately 3500 Hz.

In order to assure a comparatively uniform sound distribution for the audience up to a frequency of 5000 Hz, the loudspeakers 4 and 4' of the last section are offset relative to each other, i.e. the loudspeaker axes are made to diverge in the longitudinal plane of the column.

In this respect the directivity patterns of the individual loudspeakers 4 and 4' play a part. Although these directivity patterns are also narrow for frequencies up to 5000 Hz, the overall directivity pattern will have an angle of aperture which is stabilised at the value of the angle enclosed by the axes up to arbitrarily high frequencies. In that case no dip is formed in the directivity pattern in the 0° direction if the angle enclosed by the loudspeaker axes is smaller than the angle of aperture of the individual loudspeakers 4 and 4' respectively.

Figure 2:
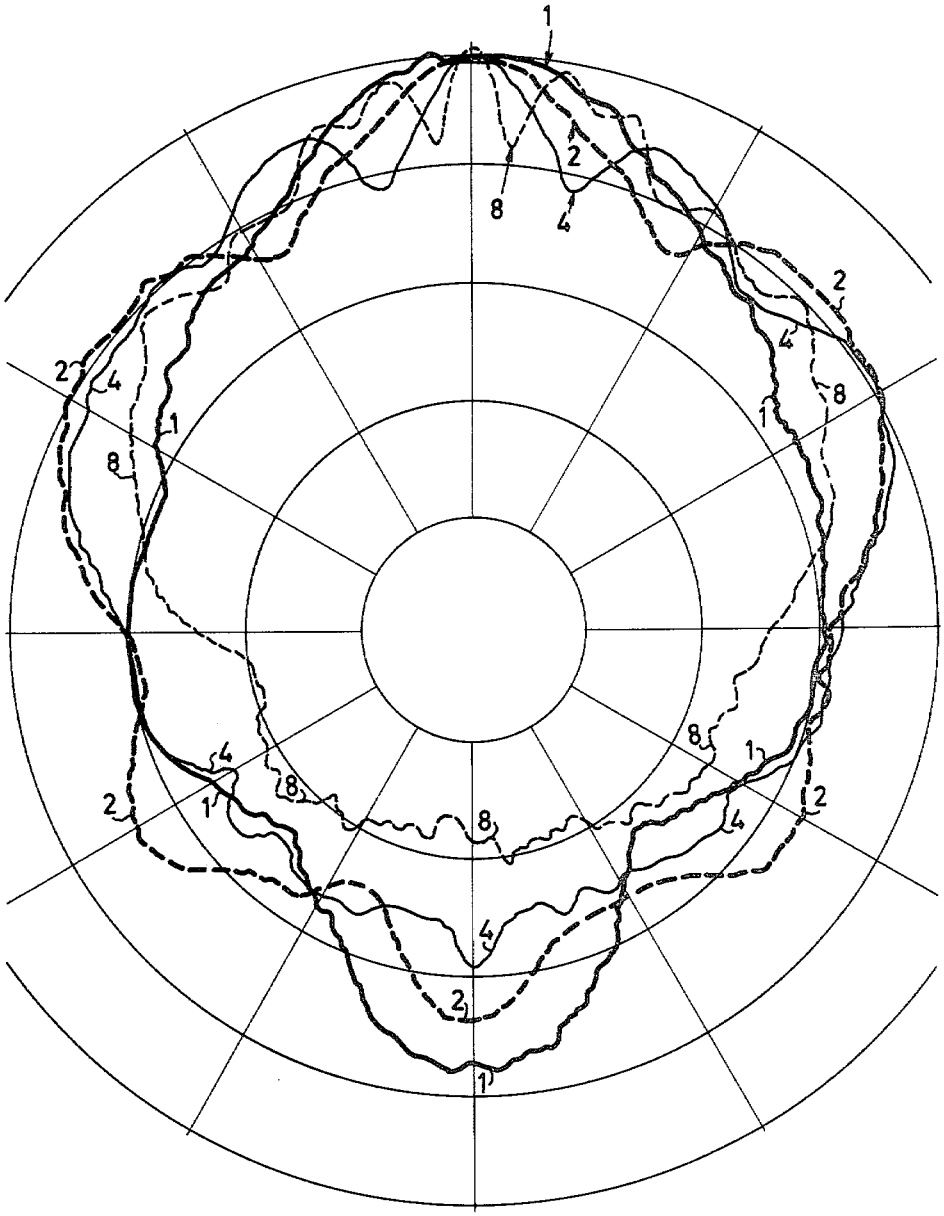
FIG. 2 shows directivity patterns at different frequencies for a column in accordance with FIG. 1.

FIG. 2 shows various directivity patterns of the loudspeaker column in accordance with FIG. 1 in a polar diagram. The values near the curves represent the frequency in kHz.

From these directivity patterns it follows that they are substantially uniform for a frequency range up to 8000 Hz.

Figure 3:
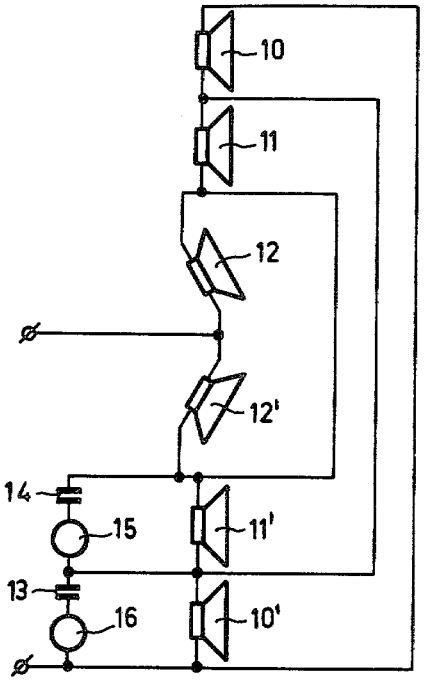
FIG. 3 shows a loudspeaker column with an incandescent lamp protection in accordance with the invention.

A variant of the loudspeaker column described above is schematically shown in FIG. 3.

The loudspeaker column comprises 3 sections of loudspeakers 10 and 10', 11 and 11', 12 and 12', which loudspeaker pairs are connected in parallel with each other. The loudspeakers 10 and 10' are provided with a parallel-connected capacitor 13; the loudspeakers 11 and 11' with a capacitor 14. The overall resistance of the loudspeakers 10 and 10' together with the capacitance of the capacitor 13 constitutes a low-pass filter with a cut-off frequency of 900 Hz. The resistance of the loudspeakers 11 and 11' together with capacitor 14 constitutes a low-pass filter with a cut-off frequency of 2500 Hz.

The operation of this loudspeaker column corresponds to that of the column in FIG. 1. The capacitors 13 and 14 are each connected in series with an incandescent lamp 16 and 15 respectively, in order to prevent serious overloading of the loudspeaker that has not been muted.

What is claimed is:

1. A loudspeaker system comprising, a pair of input terminals, a plurality of dynamic loudspeakers arranged in sections with the loudspeakers adjacent each other in substantially one continuous plane and all sections connected in series across said input terminals, a plurality of capacitors, means connecting a capacitor in shunt with each loudspeaker section but one so as to form respective low-pass filters with the respective impedances of the loudspeaker sections, said low-pass filters having different cut-off frequencies to provide progressive muting of the loudspeaker sections as the frequency increases, and said one loudspeaker section comprises at least two loudspeakers with the axes thereof diverging relative to each other.

2. A loudspeaker system as claimed in claim 1 wherein at least one of the loudspeaker sections shunted by a capacitor further comprises an incandescent lamp connected in series with the capacitor.

3. A loudspeaker system as claimed in claim 1 wherein said loudspeakers are aligned in a single straight line column and said one section comprises the central section of the column, the system further comprising means connecting all of the loudspeakers in series circuit across said input terminals.

4. A loudspeaker system as claimed in claims 1 or 2 wherein at least two loudspeaker sections each includes two loudspeakers with each loudspeaker shunted by an individual capacitor, the capacitance values of the capacitors of one loudspeaker section being equal to one another and the capacitance values of the capacitors of a second loudspeaker section also being equal to one another but unequal to the capacitance values of the capacitors of said one loudspeaker section thereby to form first and second low-pass filters having different cut-off frequencies.

5. A loudspeaker system as claimed in claims 1 or 2 wherein at least two loudspeaker sections each include two loudspeakers with each loudspeaker section shunted by an individual capacitor, the capacitance values of the capacitors of the two loudspeaker sections being chosen so as to form at least first and second respective low-pass filters having different cut-off frequencies.

6. A loudspeaker system as claimed in claims 1 or 2 wherein at least two loudspeaker sections each include two parallel connected loudspeakers and means connecting a first loudspeaker of each of said two loudspeaker sections in a first series circuit across the input terminals and a second loudspeaker of each of said two loudspeaker sections in a second series circuit across the input terminals and with said first and second series circuits connected in parallel across the input terminals.

* * * * *